United States Patent [19]

Focke

[11] 4,147,251

[45] Apr. 3, 1979

[54] DEVICE FOR CONVEYING AND STORING CIGARETTES AND THE LIKE

[75] Inventor: Heinz Focke, Verden, Fed. Rep. of Germany

[73] Assignee: Focke & Pfuhl, Verden, Fed. Rep. of Germany

[21] Appl. No.: 793,345

[22] Filed: May 3, 1977

[30] Foreign Application Priority Data

May 22, 1976 [DE] Fed. Rep. of Germany ..... 2623069

[51] Int. Cl.[2] ..... B65G 15/44

[52] U.S. Cl. ..... 198/688; 198/347; 198/698; 198/719

[58] Field of Search ..... 198/697, 698, 699, 719, 198/811, 688, 626, 347, 425

[56] References Cited

U.S. PATENT DOCUMENTS 1,422,398 7/1922 Wentz ..... 198/699

4,039,071 8/1977 Garton et al. ..... 198/688 X

FOREIGN PATENT DOCUMENTS 689938 8/1940 Fed. Rep. of Germany ..... 198/626

2353806 5/1974 Fed. Rep. of Germany ..... 198/347

*Primary Examiner*—Robert B. Reeves

*Assistant Examiner*—Douglas D. Watts

*Attorney, Agent, or Firm*—Sughrue, Rothwell, Mion, Zinn and Macpeak

[57] ABSTRACT

Air under pressure is selectively injected into raisable hollow members made of foldable material forming engagement means for movable belts which define conveying and storing elements for streams of cigarettes or the like between cigarette producing machines and packaging machines, the deflating of the hollow member acting to shift the belts from conveying function to storing function.

24 Claims, 8 Drawing Figures

DEVICE FOR CONVEYING AND STORING CIGARETTES AND THE LIKE

BACKGROUND OF THE INVENTION

1. Field of the Invention

The present invention relates to a device for conveying and storing streams or flow lines of rod-shaped articles, more specifically, cigarettes, by means of displaceable belts which are provided with engagement means for the cigarettes.

The need to convey cigarettes, either individually or in flows of cigarettes disposed parallel to and at right angles to the conveying direction arises in various sections of a production line for the manufacture and packaging of cigarettes and the like. The present invention relates specifically to the storage problem associated with the conveying of cigarettes. Cigarette storage units of the type in question are generally provided in a suitable position between the cigarette production units (extrusion machines) and the packaging machines to compensate temporary breakdowns of the machine on one side or the other by connecting in the cigarette storage unit, more specifically, by filling or emptying the same.

2. Description of the Prior Art

Various types of storage units are used for this purpose. These generally operate with rotating endless belts on which engagement means for conveying cigarettes individually or in flow lines are disposed. When cigarettes are being conveyed individually, more specifically, vertically, each cigarette is individually taken up and advanced by an engagement means. When flow lines of adjacent and superposed cigarettes are being conveyed, the engagement means penetrate the flow of cigarettes. When a cigarette flow line is vertically advanced, projecting members are disposed on each side of the belt.

In the conveying and storage device described in German Offenlegungsschrift 2,353,806 the belts are provided with triangular projections. These only penetrate a relatively short distance — relative to the breadth or height of the cigarette flow — into the flow and thereby advance the latter. This also applies to vertical flow lines. The actual engagement members consist of triangular or wedge-shaped hollow elements made of soft rubber or rubber-like material. The depth to which the engagement members penetrate the cigarette flow is about one fifth of the breadth of the flow.

The conveying performance of the engagement means provided in the above-described device for conveying and storing cirgarettes is inadequate. In addition, the cigarettes are not always satisfactorily protected from mechanical stressing during penetration of the engagement members into the cigarette flow. Lastly, the above-described engagement members offer only limited opportunities for varying the control of cigarette flow lines.

SUMMARY OF THE INVENTION

The object of the present invention is to so improve a device for conveying and preferably, for storing cigarettes and the like, that the cigarettes are not only handled gently but control variants for the cigarette flows, etc., adapted to the respective conditions are also available.

The device according to the invention which is designed to solve this problem is characterized in that the engagement members provided on the belts or the like are displaceable in such a way that they can be moved either into or out of the cigarette flow.

Accordingly, the engagement members according to the invention are displaceable relative to the belts from a conveying position in which they project into the cigarette flow to a generally flat position on the associated belt and vice-versa. In the latter position the engagement members, and hence also the belts, are essentially unaffected by advancement influences and thus there is no appreciable advancement of the cigarettes, particularly in the case of vertical flow lines.

In a preferred embodiment the engagement members are in the form of raisable hollow elements made of foldable material. These are filled with a flow medium in the raised position, more specifically, air. The engagement members consist of hollow element which can be moved into the advancement position directed generally at right angles to the belt through being inflated and which can be moved into a position in which they are not advanced by releasing or discharging the air.

Control of the engagement members is afforded in that the belts are divided into sections and are connected with air sources such as air tanks which are variably controllable from section to section. As a result, extensive control variability in terms of the direction of movement of the cigarettes or cigarette flows is obtained.

The belts equipped with engagement members of the type defined above are preferably used in devices designed for storing and conveying cigarettes. According to the invention this consists of at least two endless belts which are each equipped with engagement members and which form at least one vertical conveyor section with two oppositely disposed belts and at least one horizontal storage section.

The system is preferably designed in such a way that a plurality of cirgarette producing machines and packaging machines are connected together via a synchronized cooperating system of belts forming upright conveying sections and horizontal storage sections.

Other objects, features and advantages of the present invention will be made apparent in the following description of preferred embodiments thereof provided with reference to the accompanying drawings.

DESCRIPTION OF THE PREFERRED EMBODIMENTS

The embodiments described herein relate to the conveying and storage of cigarettes 10 which are conveyed and possibly stored in a cigarette flow 11 consisting of a plurality of adjacent and superposed cigarettes.

Figure 1:
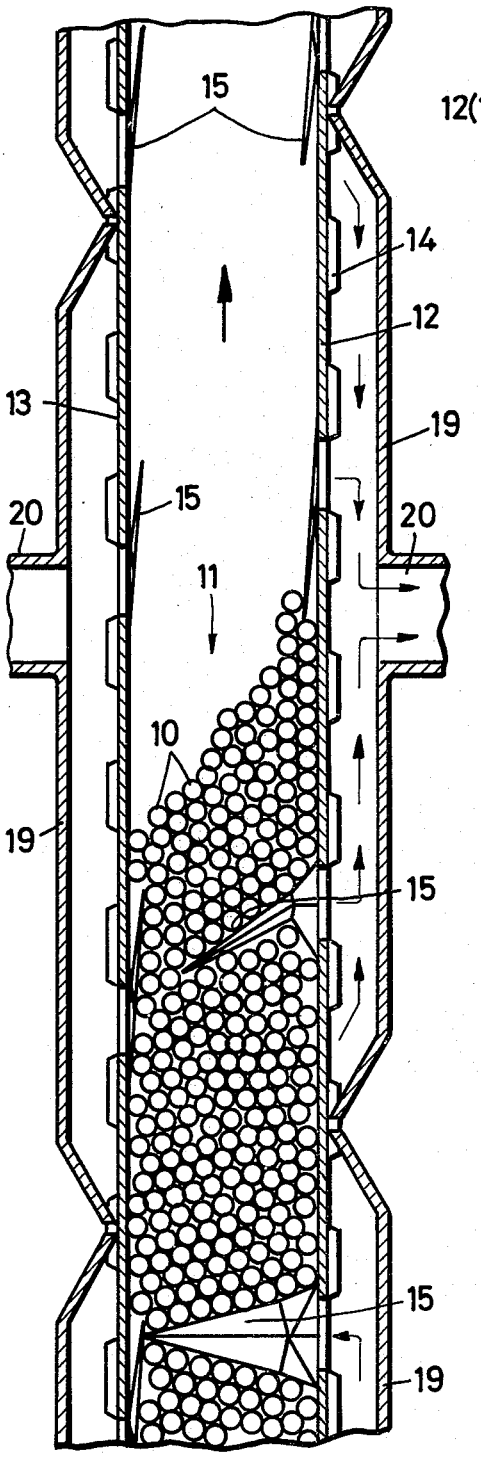
FIG. 1 is a vertical sectional view of a vertical conveyor section consisting of two oppositely disposed belts.
Figure 2:
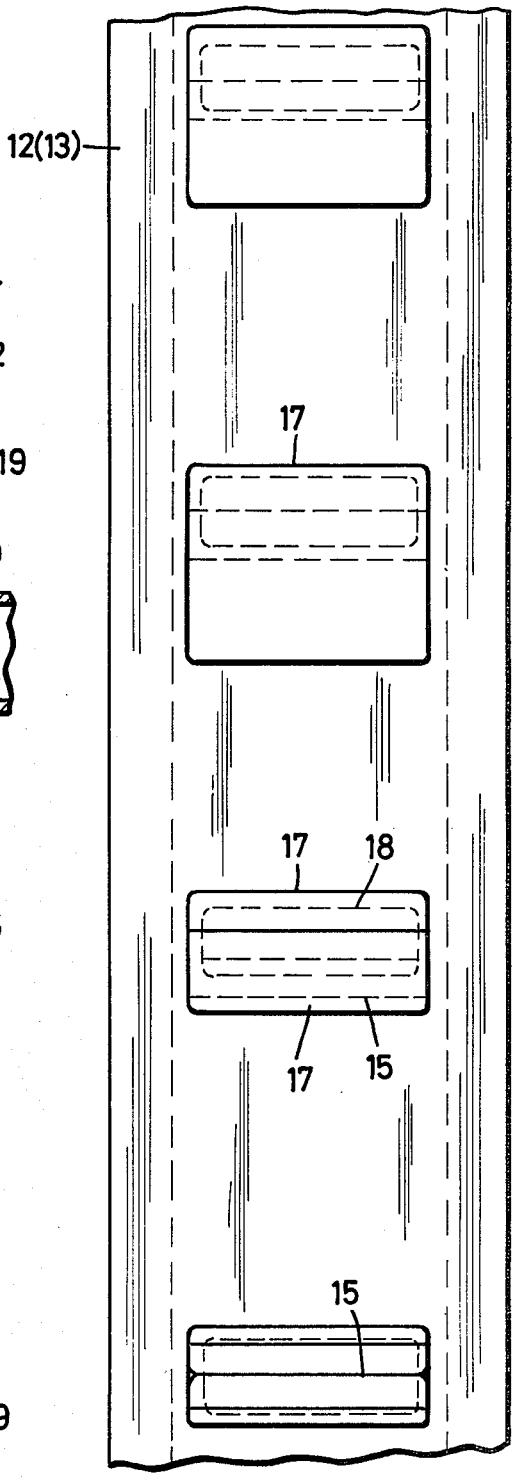
FIG. 2 is a plan view of one of the belts shown in FIG. 1.
Figure 3:
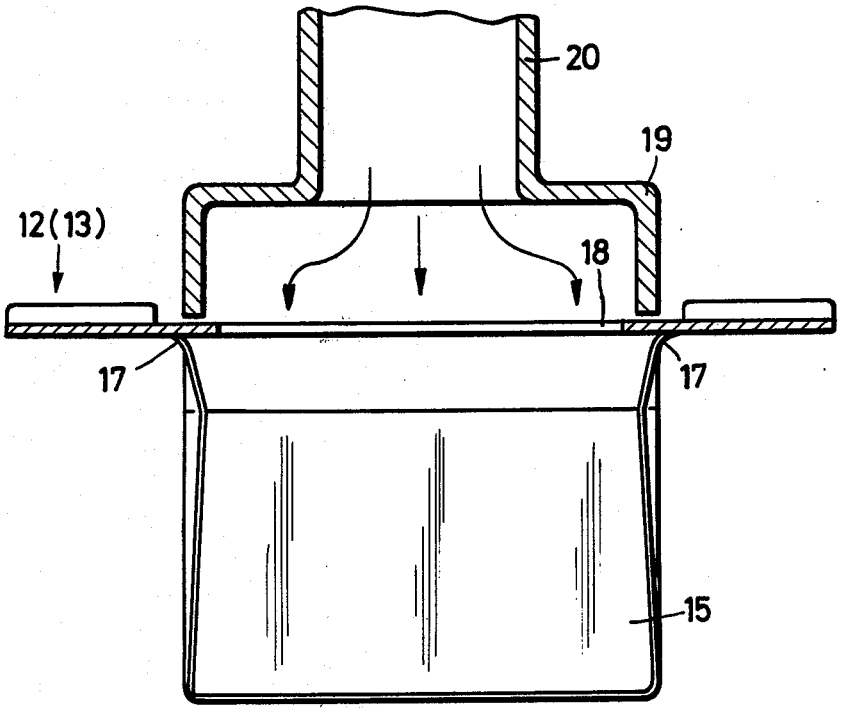
FIG. 3 is a cross-sectional view on an enlarged scale through a belt in the region of an air connecting duct.

Rotating endless belts 12 and 13 are designed to convey the cigarettes 10. These belts 12 and 13, consisting, for example, of textile material coated with plastic, are designed to convey a cigarette flow 11 in a vertical direction. The belts are disposed opposite one another as a pair forming a conveyor shaft (FIG. 1). On their side remote from the cigarette flow 11, the belts 12 and 13 are laterally equipped with a denticulation 14 which ensures the drive of the belts 12 and 13.

The belts 12 and 13 are equipped with engagement members 15 on their side facing towards the cigarettes 10. The engagement members are suitably spaced apart from one another to obtain the desired conveying action. They are attached to the belts 12 and 13.

The engagement members 15 are designed so as to project into the cigarette flow 11 at right angles to the belts 12 or 13 so as to advance the cigagettes 10. They preferably extend beyond the longitudinal median plane of the cigarette flow 11. In the present case, the engagement members 15 of adjacent belts 12 and 13 are offset with respect to one another. When the belts 12,13 are driven at different rates this relative position of the engagement members 15 will vary.

Figure 4:
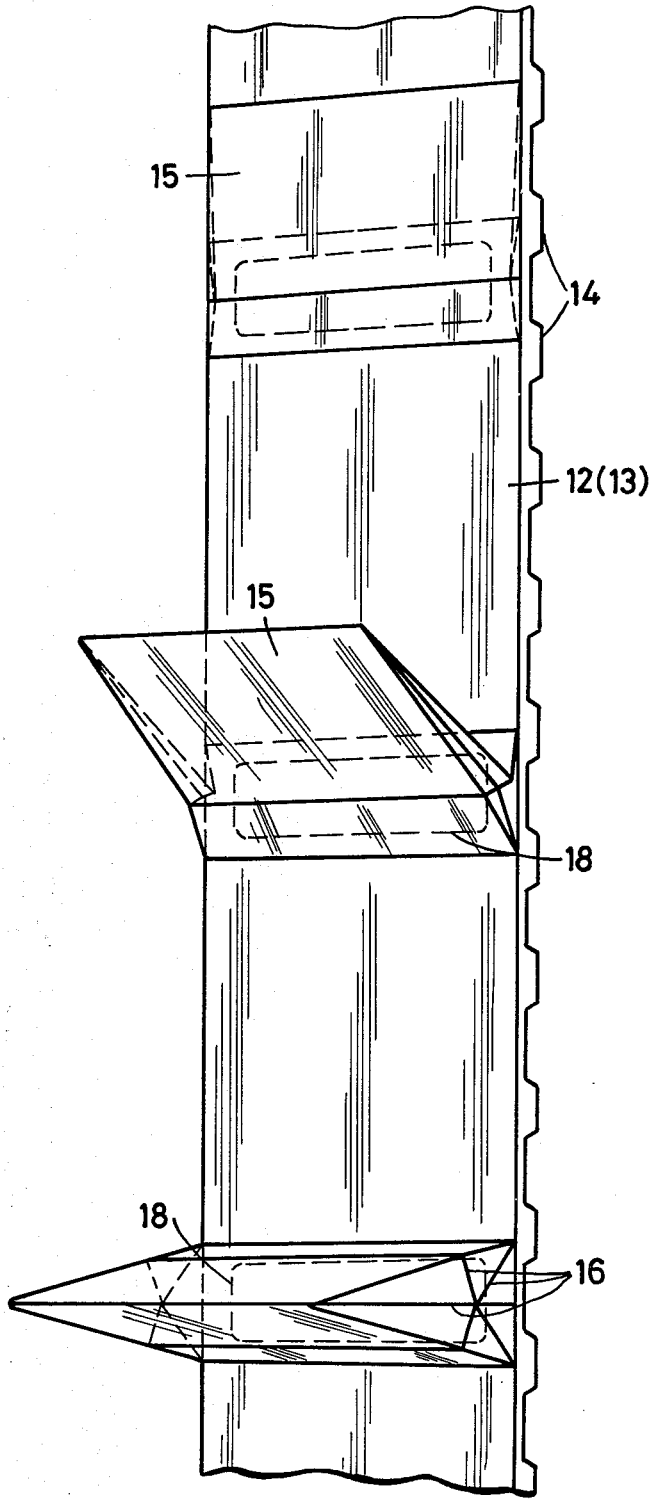
FIG. 4 is a perspective view of a section of a belt with the engagement members in different positions.

The engagement members 15 can be moved from the conveying position (bottom of belt 12) into a neutral position in which they lie in an essentially flat position against the respective belt. Accordingly, the engagement members 15 are in the form of raisable, more specifically, inflatable hollow elements. They have a wedge-shaped cross-section. The foldable wall is provided with corresponding pre-makred fold lines 16 (FIG. 4) which make it easier to collapse the engagement member 15 in the neutral position. The engagement members 15 preferably consist of a plastic foil, a thin leather or suitable textile material. They are connected, for example, by means of adhesion, in an airtight manner via a bottom edge 17 with the upper face of the belt 12 or 13 in the region of an opening 18 formed in the belt. Compressed air is supplied to the engagement member via this opening 18 to raise it into the engagement position shown in FIG. 4. The air is also released or discharged through this opening 18 to enable the engagement 15 to lie flat against the belt 12 or 13.

Air connections are provided for the engagement members 15 on the opposite sides of the belts 12 and 13 to the cirgarettes 10. In the present embodiments sections of the belts 12 and 13 are supplied in common with compressed air or air is removed in common. The air is supplied via air tanks 19 which are rigidly mounted on the rear side of the belts 12 and 13. They are spaced sufficiently far from the belts 12 and 13 to ensure that the displacement of the belts is not impaired but also that only a limited amount of air is lost. Each air tank 19 is connected via a connection line 20 with a compressed air source (not shown).

Owing to the fact that the belts 12 or 13 are divided, resp., the engagement members 15 are controlled in individual sections, the conveying operation can be optimally adapted to the existing conditions. The engagement members 15 lying against the belts 12,13 can be carefully moved by means of compressed air into the cigarette flow 11 without damaging the cigarettes 10, namely in the region of an air tank 19. If an engagement member 15 which is raised in the conveying position reaches an air tank 19 from which the air has been released or which is connected to a vacuum source, that particular engagement member is removed from the cigarette flow 11 until it rests in an essentially flat position on the belt 12 or 13. This rest position of the engagement members 15 is such that even when a belt (in FIG. 1, belt 13) is displaced in the opposite direction to the conveying direction of the cigarette flow 11, a conveying influence is not exerted on the cigarette flow 11.

Owing to the multiple control features the engagement members 15, resp., the belts 12,13 equipped with these engagement members, can be used for many different purposes. FIGS. 5–8 show an embodiment of a conveying and storage system wherein a plurality, namely three cigarette producing machines 21,22,23 are associated with a plurality more specifically two packaging machines 24 and 25. These production and processing units are connected together by a plurality of belts 12,13 equipped with engagement members 15 in such a way that a plurality of storage units are formed. According to the particular conditions, these are able to compensate over-production on the production side or counteract under-production.

The design of the system is such that vertical conveying sections 26,27,28,29,30 are disposed between the cigarette producing machines 21,22,23 and the packaging machines 24 and 25. These vertical conveying sections each consist of two oppositely disposed belt sections. These are, in turn, formed by a plurality of rotating belts 31,32,33,34,35, 36.The afore-mentioned belts pass over partially driven deflecting rollers 37. The belts 31,33 and 35 are each equipped with four deflecting rollers and the belts 32,34 and 36 with five deflecting rollers.

The belts 31–36 are divided by the deflecting rollers 37 into horizontal and vertical sections which are, in turn, associated with air tanks 19 extending over one such section. The connecting ducts 20 to these air tanks 19 lead to a common compressed air source or vacuum source. Blocking elements or valves are disposed in the connecting ducts 20. These blocking elements 38 provide individual control of the sections associated with the relevant air tanks 19.

In the present case the outer belts 31 and 36 are in the form of storage units. The belt 31 comprises a horizontal storage section 39 and a vertical storage section 40. The latter cooperates with a vertical counter element 41 which is not provided with an engagement member. The storage unit of the belt 36 is formed by an upper horizontal storage section 42.

Figure 5:
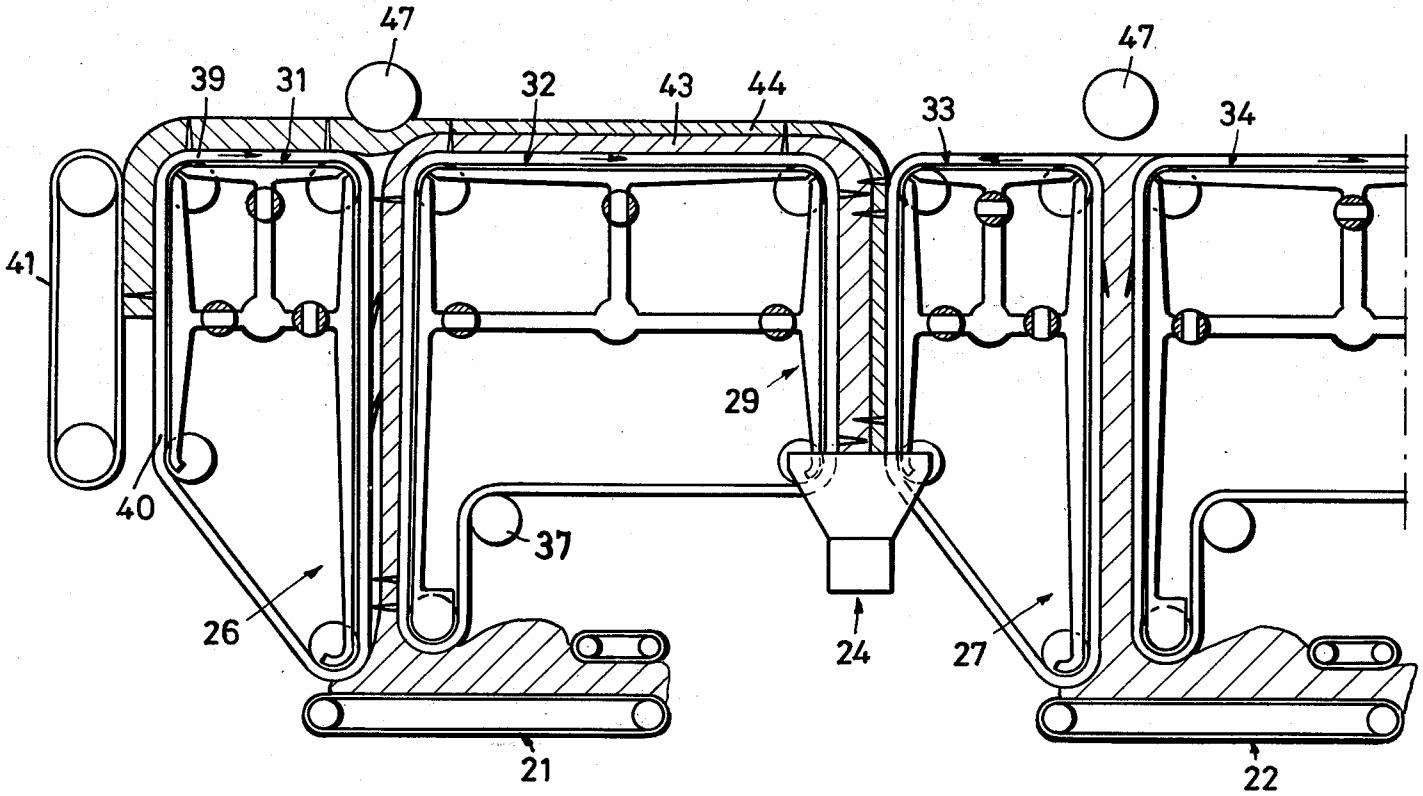
FIGS. 5 and 6 show adjacent parts of a device for conveying and storing cigarettes.
Figure 6:
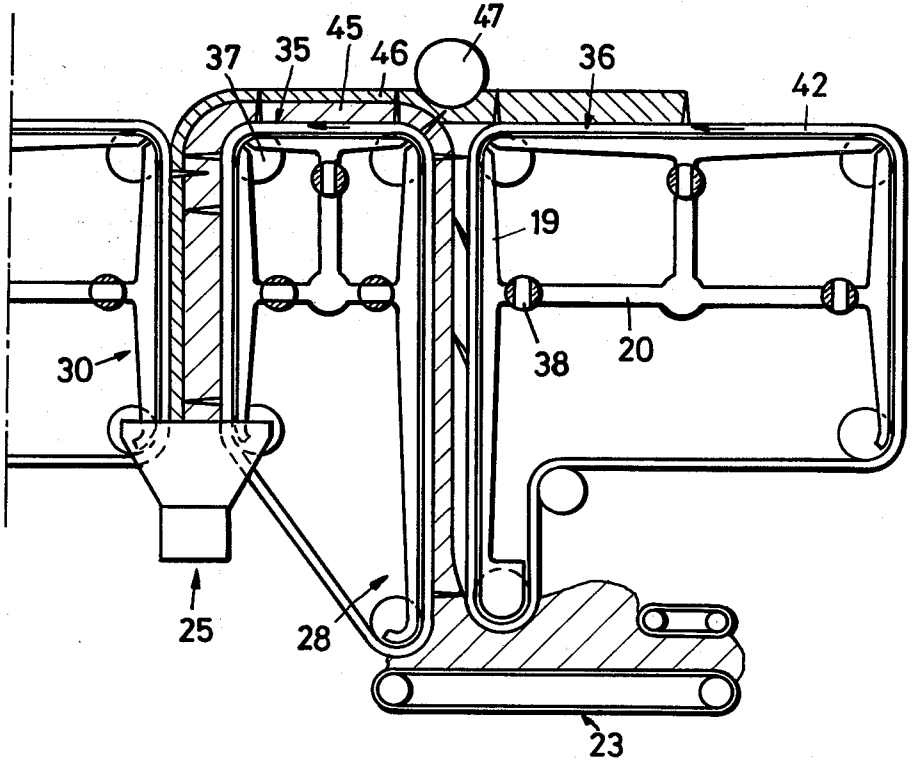

FIGS. 5 and 6 show an operating position wherein the central cigarette production machine 22 is temporarily out of action. The belts 33 and 34 are controlled in such a way that the engagement members of the vertical conveying section 27 lie flat against the respective belts, i.e., do not perform a conveying function although the belt sections in question are vertically displaced with the belts 33 and 34. Accordingly, no cigarettes are conveyed in the region of the conveying section 27. The packaging machines 24 and 25 are supplied by the cigarette producing machines 21 and 23. The difference, namely a third of the quantity taken up by each packaging machine 24 and 25, is removed from the storage unit 39/40 or 42. The engagement members of the belts 31 and 32 and also 35 and 36 are thus extended into the storage zone. As a result, partial cigarette flows 43 and 44 or 45 and 46 are combined in the region of the belts 32 and 35. Guide rollers 47 are mounted above the conveying sections 26,27 and 28 to ensure correct transfer and adjustment of the partial flows.

Figure 7:
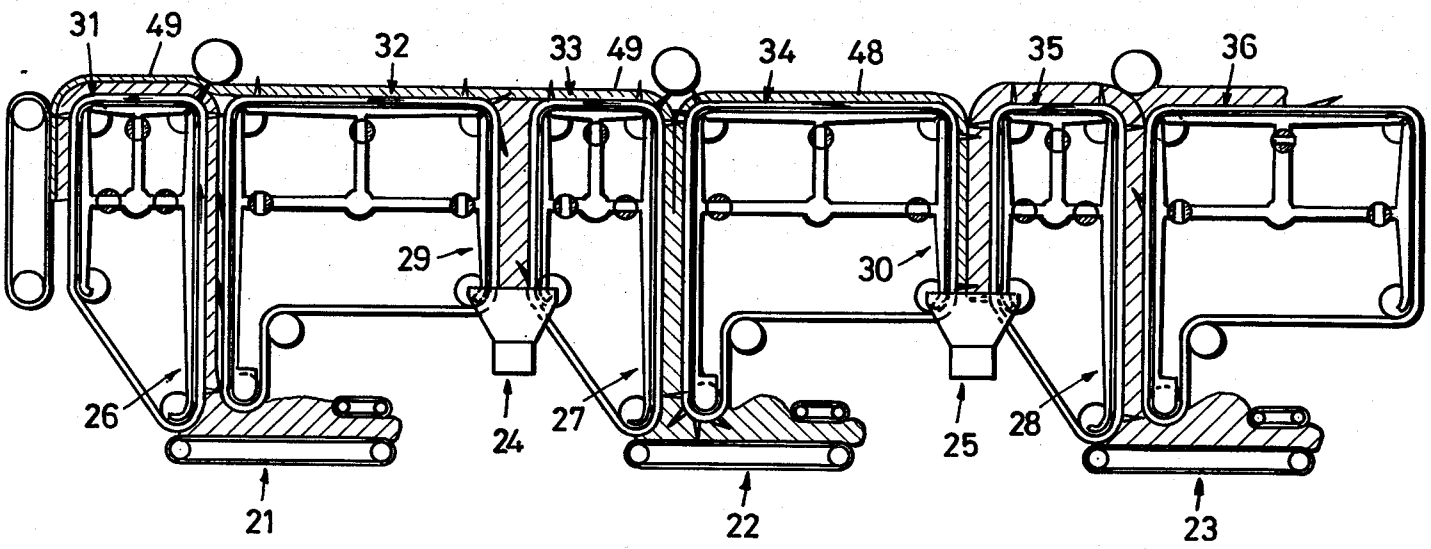
FIG. 7 shows the device according to FIGS. 5 and 6 on a smaller scale and in a different operating position.

The operating state shown in FIG. 7 proceeds from stoppage of the packaging machine 24. As the cigarette machines 21–23 continue to supply cigarettes, an excess of cigarettes must be supplied to the storage units. This is achieved in that the quantity of cigarettes supplied by the cigarette producing machine 23 remains unchanged and is supplied by the belt 35 directly to the packaging machine 25. The packaging machine is not yet fully loaded thereby, but a partial flow 48 is additionally supplied from the cigarette producing machine 22 by the belt 34. The other partial flow 49 from this cigarette producing machine is supplied by the belt 33 and the adjacent belt 32 to the storage unit 39/40. The full capacity of the cigarette producing machine 21 is also supplied to the storage unit via the belt 31.

The air is released from the vertical belts sections of the belts 32 and 33 associated with the conveying section 29 such that the engagement members 15 of the rotating belts 32 and 33 do not exert a conveying action in the region of conveying section 29. Similarly, the downwardly displaced section of the belt 32 in the region of the conveying section 26 is switched to evacuated engagement members 15 such that the cigarettes in this conveying section 26 can be moved upwards by the belt 31 inspite of the oppositely directed section.

Figure 8:
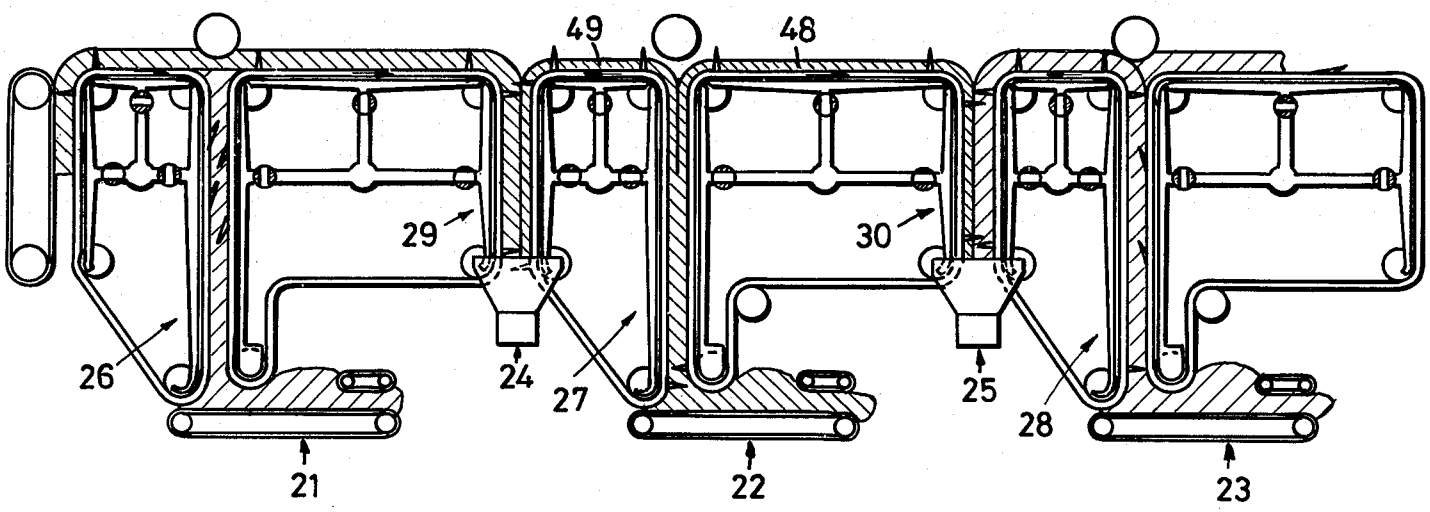
FIG. 8 corresponds to the view shown in FIG. 7 in another operating position.

The operating state shown in FIG. 8 occurs when the cigarette producing machine 21 is interrupted. The resulting lack of cigarettes is compensated by the storage unit 39/40. A quantity of cigarettes corresponding to the output capacity of the cigarette producing machine 21 is removed by the belt 31 from the storage unit and supplied via the belt 32 to the packaging machine 24. The latter also receives a partial flow 49 from the cigarette producing machine 22. The other partial flow 48 of production machine 22 is supplied to packaging machine 25 via the belt 34. The output of cigarette producing machine 23 is supplied in its entirety to the packaging machine 25 via the belt 35.

As in the case of the operating state shown in FIG. 7, the belt 36 can be switched to the inoperative state. The vertical sections of belts 31 and 32 are switched to the inactive position of the engagement members 15 in the region of the conveying section 26.

The above arrangement can also be used in other combinations, for example, packaging machines having a reduced capacity or with more packaging machines and cigarette producing machines.

The air tanks 19 are associated with the respective belt sections in such a way that the engagement members 15 can be moved gently into the cigarette flow 11. This applies, in particular, to the area of the lower deflecting rollers 37 of conveying sections 26,27 and 28. The deflection of the air tanks 19 in this region is such that the engagement members are increasingly raised during the movement of the belts about the deflecting rollers 37 and penetrate the cigarette flow 11.

In the embodiment shown in FIGS. 5–8 the disposition of the individual belts 31–36 is such that the units consisting of two belts 31 and 32,33 and 34, 35 and 36 are associated with each cigarette producing machine 21,22,23. The belts for these units form with the belts of the adjacent unit vertical conveyor section 29 and 30 which is represented. The length of the belt sections for the latter conveyor sections 29 and 30 is greater than the length of the belt sections for conveyor sections 26,27,28. The latter merely have to receive the output of a cigarette producing machine 21,22,23 whereas conveyor sections 29 and 30 must convey the—higher—output of a cigarette producing machine 21 or 22 and 23.

The ducts 20 leading to the air tanks 19 are connected with a compressed air resp., vacuum source having a high conveying capacity with slight under or over-pressure. They preferably make use of commercially available fans having a corresponding capacity.

What is claimed is:

1. In an apparatus for selectively conveying or temporarily storing a plurality of rod-like articles such as cigarettes axially aligned parallel to each other and transverse to the direction of conveyance, and including two spaced, generally parallel planar elements defining opposite walls of a cigarette stream conveying or storing section between them, at least one of said elements comprising a movable belt having a plurality of spaced cigarette engaging members mounted thereon on the side facing the conveying or storing section, the improvement characterized by:

each of said engaging members comprising a selectively raisable element extendable to project into the cigarette stream in a transverse direction to implement conveying, and retractable out of the cigarette stream to implement temporary storing even during the movement of said belt, each selectively raisable element being made of a foldable material and extendable to a projecting conveying position by inflation with air.

2. The apparatus as claimed in claim 1, wherein said engaging members are selectively retractable from the cigarette stream to a generally flat position adjacent the belt.

3. The apparatus as claimed in claim 1, wherein said engaging members are collapsible.

4. The apparatus as claimed in claim 1, wherein said engaging members are held in the raised position by a stiffening means.

5. The apparatus as claimed in claim 3, wherein said engaging means are hollow.

6. The apparatus as claimed in claim 5, further comprising means for selectively connecting said engaging members to a compressed air source to raise them and to a vacuum source to collapse them.

7. The apparatus as claimed in claim 6, wherein said engaging members are connected to the compressed air source or the vacuum source via an opening providing in the belt.

8. The apparatus as claimed in claim 1, wherein said engaging members have a triangular-shaped cross-section in the raised position and comprise triangular side walls provided with pre-marked fold lines.

9. The apparatus as claimed in claim 7, wherein said engaging members are adhesively attached to the belt with lugs or the like disposed on the edges facing toward the belt.

10. The apparatus as claimed in claim 6, wherein said compressed air source or vacuum source is designed for a large air delivery quantity with a minimum over or underpressure, through the use of at least one fan.

11. The apparatus as claimed in claim 6, wherein said engaging members are controllable in common along a section of the belt by means of an air tank extending over the section on the opposite side of the belt from said engaging members.

12. The apparatus as claimed in claim 1, wherein the belt is endless and is guided via deflecting rollers, and the positions of the engaging members associated with a belt run disposed between adjacent deflecting rollers are controlled in common.

13. The apparatus as claimed in claim 1, wherein the cigarette stream is conveyed and stored between oppositely disposed belts, at least one of which is equipped with engaging members.

14. The apparatus as claimed in claim 13, wherein the length of the raised engaging members is greater than the half width of the cigarette stream section formed between opposite belts.

15. The apparatus as claimed in claim 13, wherein oppositely disposed belts have belt sections variably controllable in opposite directions with said engaging members thereof being moved into different positions such that the displaced belts are adjusted so as either to convey the cigarette stream or to temporarily store it.

16. The apparatus as claimed in claim 1, comprising at least two endless belts, each belt comprising engaging members, disposed between a cigarette producing machine and a packaging machine to convey and store the cigarettes, said endless belts forming at least one vertical conveyor section with two oppositely disposed belt sections and at least one horizontal storage section.

17. The apparatus as claimed in claim 16, wherein the cigarette stream is supplied to the packaging machine via a downwardly conveying conveyor section formed by two oppositely disposed belt sections each comprising engaging members.

18. The apparatus as claimed in claim 16, wherein the belts are passed over at least four deflecting rollers, and wherein the positions of the engaging members on two vertical belt sections and an upper horizontal section are each controllable individually.

19. The apparatus as claimed in claim 16, wherein a plurality of belts form vertical conveyor and horizontal storage sections and are associated with a plurality of cigarette producing machines and packaging machines.

20. The apparatus as claimed in claim 19, wherein a unit consisting of two endless belts equipped with engaging members is provided for each cigarette producing and packaging machine, and wherein a vertical conveyor section leads to the packaging machine and is formed by the belt sections of adjacent units.

21. The apparatus as claimed in claim 19, wherein the conveyor and storage sections are coupled together with respect to the reception and delivery of cigarettes through control of the engaging members and drive systems for the belts.

22. The apparatus as claimed in claim 15, wherein the length of the belt sections of a conveyor section leading to a packaging machine is greater than the length of the belt section of a conveyor section coming from a producing machine.

23. The apparatus as claimed in claim 21, wherein the cigarette streams coming from the cigarette producing machines are divisible into partial flows upon leaving the vertical conveyor section and are displaceable together with other cigarette streams.

24. The apparatus as claimed in claim 1, wherein ducts of at least one belt lead to air tanks and are connected to a common compressed air or vacuum source, and a separately operable valve element is disposed in each duct.

* * * * *